United States Patent [19]

Munday et al.

[11] Patent Number: 4,990,179

[45] Date of Patent: Feb. 5, 1991

[54] PROCESS FOR INCREASING THE LIFE OF CARBON CRUCIBLES IN PLASMA FURNACES

[75] Inventors: Theodore F. Munday, Kendall Park; Richard A. Mohr, Martinsville, both of N.J.

[73] Assignee: FMC Corporation, Philadelphia, Pa.

[21] Appl. No.: 513,121

[22] Filed: Apr. 23, 1990

[51] Int. Cl.[5] ..... C22B 4/00

[52] U.S. Cl. ..... 75/10.19; 266/275; 266/280; 373/72

[58] Field of Search ..... 75/10.19; 266/275, 280; 373/72

[56] References Cited

U.S. PATENT DOCUMENTS

| | | | |
|---|---|---|---|
| 1,274,479 | 8/1918 | Wenman | 423/10.35 |
| 1,836,618 | 12/1931 | Pokorny | 423/322 |
| 3,002,824 | 10/1961 | Francois | 23/301 |
| 3,699,213 | 10/1972 | Cosman et al. | 423/322 |
| 3,783,167 | 1/1974 | Tylko . | |
| 4,093,190 | 6/1978 | Sprunck et al. | 266/47 |
| 4,466,824 | 8/1984 | Gauvin et al. | 75/10 R |
| 4,806,325 | 2/1989 | Munday et al. | 423/322 |
| 4,883,258 | 11/1989 | Foster | 75/10.19 |

*Primary Examiner*—Peter D. Rosenberg

*Attorney, Agent, or Firm*—Frank Ianno; Robert L. Andersen

[57] ABSTRACT

The excessive wear and formation of ring-like cavities in carbon crucibles used to contain iron-based compositions that are heated in a plasma furnace to a temperature of from about 2000° C. to aboout 2700° C. are reduced or eliminated by adding carbon particles to the crucible in amounts of at least about 6 weight percent of the melt, and preferably in amounts exceeding the solubility of carbon in the heated melt.

11 Claims, No Drawings

PROCESS FOR INCREASING THE LIFE OF CARBON CRUCIBLES IN PLASMA FURNACES

The present invention relates to a process for increasing the life of carbon crucibles used in treating iron-based compositions in plasma furnaces at temperatures of from 2000° C. to 2700° C. In the present description, the iron-based composition that is exemplified and reviewed is ferrophos, although other suitable iron-based compositions can be treated as described herein. Such other compositions include ferrochromium, ferromanganese, ferrosilicon and ferrovanadium. The term "iron-based" composition, is intended to describe any melt, material or composition where iron is present as one of the largest components (as weight percent) and preferably one that contains at least about 50% by weight of iron as combined and/or free iron.

It is known that ferrophos can be treated in a plasma furnace to recover elemental phosphorus and a valuable metals concentrate, rich in vanadium and chromium having reduced amounts of phosphorus. This process is described in U.S. Pat. No. 4,806,325 issued to Theodore F. Munday and Richard A. Mohr on Feb. 21, 1989. The feed material used in this process is ferrophos, an iron-based by-product of the electric furnace process for preparing phosphorus. In this process, a phosphate-bearing ore is charged to an electric furnace with silica and with a source of carbon, usually coke, until the furnace charge has been heated to about 1500° C. and the phosphorus-bearing ore yields elemental phosphorus. This is removed as a vapor and recovered along with carbon monoxide gas while from the base of the furnace an upper layer of molten slag and a lower layer of molten ferrophos are tapped and cooled. The ferrophos is rich in phosphorus containing as much as 27% phosphorus by weight and also containing smaller, but commercially important amounts of metals. The most important of these are vanadium and chromium which are present in amounts of about 5% each. The remainder of the composition is iron and is present in amounts of at least 50% by weight, and usually in amounts of about 60% by weight. The exact amounts of these metals will depend upon the phosphate-bearing ore used in the furnace and the furnace conditions employed in treating the ore.

In carrying out the process of the '325 patent, ferrophos is treated in a plasma arc furnace of the transferred-arc type until the ferrophos has been heated by the plasma arc until it reaches a temperature of from about 2000° C. to about 2700° C., at which temperature gaseous phosphorus is evolved from the heated ferrophos and recovered leaving a concentrate having less than about 7% by weight phosphorus and whose metals concentration, for example, vanadium and chromium, have been increased. The high heat generated in this plasma arc furnace requires the use of furnace receptacles which are especially constructed and usually made of carbon because normal refractories such as silica and chrome-magnesite cannot withstand the high temperatures present in the furnace. Carbon crucibles have been found ideal for use in these plasma arc furnaces because the melt does not chemically attack the carbon and the elemental carbon material of construction can withstand the high heat present in the furnace without softening or losing its structural strength.

One problem that has occurred in the use of these carbon crucibles has been the formation of a ring-like cavity around the inner walls of the carbon crucible beginning at the level of the surface of the melt and extending for an inch or so lower down the walls. The wearing away of the inner walls of the carbon crucible at this point is serious because it continues to wear with additional melts and rapidly requires replacement of the carbon crucible. The reason for the wear of the carbon crucible at this melt line was unknown. It was not believed to be due to chemical attack because the rest of the carbon crucible was not chemically attacked by the melt in any way. Further, it was not considered to be a normal wear phenomena brought about by rapid agitation of the molten metal at its surface, since no stirring is normally used in these vessels. Any agitation comes about gently, caused by convection, due to temperature differentials in the melt.

It has now been found that the excessive wear and formation of ring-like cavities in carbon crucibles used to contain iron-based compositions that are heated in a plasma furnace to a temperature of from about 2000° C. to about 2700° C. can be reduced or eliminated by adding carbon particulates to the crucible in amounts of at least about 6 weight percent of the melt and preferably in amounts exceeding the solubility of carbon in the heated melt. In a most preferred embodiment of the invention, sufficient amounts of particulate carbon particles are added to maintain carbon particles floating on the melt surface in a ring-like shape adjacent to the inner walls of the carbon crucible.

In carrying out the present invention, a carbon crucible is used as the container to hold the iron-based composition which is to be heated in the plasma arc furnace. In general, plasma arc systems fall into two categories, namely, nontransferred-arc and transferred-arc devices. In either device, the plasma arc is generated between at least two electrodes, one being an anode, and the other being a cathode. The plasma gas that is passed between the electrodes is a gas that is rendered electrically conductive by heating and by ionization of some of the atoms. The nontransferred-arc devices have what is sometimes termed "an internal anode" and "cathode" such as the dc jet arc, in which the plasma-forming gas is blown through a nozzle between a cathode and a water cooled anode in close proximity. The plasma emerges from the nozzle in the form of an expanding jet or tail flame at a very high velocity. In use, the device is placed near the work piece to be heated so that the plasma tail flame impinges on or is close to the work piece and transfers its heat to the work piece as required.

In the transferred-arc system, one of the electrodes, normally the anode, serves as the work piece and the plasma arc is struck between one electrode and the work piece with the plasma gas being introduced between the two. In this type of plasma generator, a long (normally DC) arc ranging from a few centimeters to a meter is struck between the cathode and an anode. The arc takes the form of a column of plasma gas at a high temperature. The temperature is highest near the tip of the cathode and decreases slowly as the anode is approached. The temperature near the cathode is extremely high and has been reported as being 20,000° K. when argon is used as the plasma.

In the practice of the present invention, it is possible to employ a plasma arc furnace which is of either the transferred-arc type or nontransferred-arc type, although when treating ferrophos as the iron-based composition to recover elemental phosphorus and an enriched metal concentrate, it is preferred to employ the transferred-arc type furnace. Typical transferred-arc type furnaces which may be employed are those described in U.S. Pat. No. 3,783,187 issued to Jozef K. Tylko on January 1, 1974, and in U.S. Pat. No. 4,466,824 issued to William H. Gauvin and George W. Kaubanek on Aug. 21, 1984. The Tylko plasma furnace has an upper electrode capable of moving along its own longitudinal axis and forms the plasma arc with a lower stationary annular electrode. The upper electrode which can move about its own longitudinal axis is rotated at a given rate so that the plasma arc touches different locations in the collector, which is one species of the annular electrode, normally the anode, in the furnace.

The Gauvin et al. plasma furnace utilizes a sleeve mounted in an annular relationship to the cathode and plasma arc so that feed material fed with the carrier gas against the inner wall of the sleeve melts under the heat energy radiated by the plasma arc and forms a molten mass of material on the inner surface of the sleeve which results in a falling film of molten material flowing down the inner wall of the sleeve and dropping into a crucible beneath the sleeve where the plasma arc terminates.

In carrying out the present invention, with a furnace having a transferred-arc device, the upper electrode, which is normally the cathode is preferably water cooled to protect the cathode against excessive attack. Carbon electrodes, especially those having a hollow core, and without water cooling can also be used as cathodes to protect against overheating. The second electrode, which is normally the anode, is located at the base of the furnace and is connected to a receptacle in an electrically conductive manner. In these furnaces, the receptacle is a carbon vessel which can contain the heated melt and which is not deleteriously effected by the high heat present in the furnace.

After placing an electrical potential across the cathode and anode, an arc is struck between the two electrodes by moving the cathode down in proximity to or in contact with the anode. Often a small AC spark can be used to initiate the DC arc formation. At the same time, a plasma gas which is inert to phosphorus, such as argon, is passed down a sleeve surrounding the cathode or through a hollow core in the electrode so that it is introduced into the arc between the cathode and anode. At this point, the plasma gas ionizes and forms a plasma arc between the two electrodes which is both stable and continuous. The upper cathodic electrode is then moved vertically up until the length of the arc between the cathode and anode reaches a desirable working length.

In general, the length of the plasma arc is determined by the amount of power required to raise the temperature of the furnace, and the feed therein, to the desired temperature. The longer the arc, the greater is the power required to sustain the arc and which is available to heat the feed. However, it is not desired to have too long an arc because the longer the arc the greater is the heat loss by radiation along the extended length of the arc not in contact with the feed material.

Once the plasma arc has bene established and its length fixed to desirable limits, the feed material is the fed continuously, or in batch, into the furnace. In general, the ferrophos feed is crushed and fed to the plasma furnace through a port in that furnace. To this feed carbon is added in amounts of at least 6% by weight of the feed to the furnace, by itself or preferably mixed in the ferrophos feed. The carbon which can be in the form of graphite, elemental carbon, coke, calcinates of coal, and any form of coal including anthracite or bituminous coal, is added in amounts of lest 6% by weight of the melt and preferably in amounts at least equal to the solubility of carbon in the melt. Added amounts ranging from about 6% to about 10% by weight of the melt have been found effective. As an alternate to adding the carbon by itself or mixed with the ferrophos feed, it can be added to the surface of the melt or injected under the surface, since it will float in any case as discrete particulates of carbon. In a most preferred embodiment sufficient amounts of the particulate carbon particles are added to maintain carbon particles floating on the melt surface in a ring-like shape close to the inner wall of the carbon crucible.

In the case of the Gauvin et al. furnace, the feed is fed through an orifice inside of the sleeve surrounding the plasma arc. In this way, the feed is heated and melts along the inside of the sleeve by virtue of heat absorbed from the upper portion of the plasma arc. It then drips down into the carbon crucible at the bottom of the furnace into which the plasma arc terminates. It then is heated directly by the plasma arc that contacts the surface of the molten feed. Carbon can be added along with the crushed ferrophos feed through the furnace orifice, or alternately can be added to the molten feed through a separate feed tube.

In the Tylko apparatus, the crushed ferrophos may be fed directly into the plasma arc where it is heated in its downward travel through the arc to the carbon crucible at the base of the furnace. The ferrophos feed may also be fed continuously into the carbon crucible. Alternatively, the feed may be placed in a single charge in the carbon crucible at the base of the furnace where batch type processing is desired. In either of these situations, carbon may be added or mixed with the crushed ferrophos or it may be incorporated with the single charge placed in the carbon crucible. Alternatively, the powdered carbon may be added to the melt in the carbon crucible continuously or in one charge into the melt itself.

In either type of furnace, the plasma arc ends up terminating at at least one point on the surface of the molten ferrophos in the collector. As a result of the heat given off by the plasma arc extending between the cathode tip and the surface of the molten ferrophos, the temperature of the ferrophos can be increased until it reaches a temperature of from abut 2000° C. to about 2700° C., preferably, from abut 2200° C. to about 2300° C. While this represents the average temperature of the molten ferrophos in the collector, the temperature at the spot on the surface of the ferrophos where the plasma arc contacts the ferrophos is much higher because the temperature of the ionized plasma gas in the core of the arc can be at least 15,000° C., and transfers heat at this high temperature to the point on the surface of the ferrophos (termed the "anode spot") where the arc actually touches the ferrophos surface.

The transfer of heat at the anode spot is not only due to the high temperature of the ionized plasma gas, but also to the decay of the arc and the recombination of the ionized plasma gas which liberates the high energy required for ionization. This localized hot temperature at the anode spot causes the ferrophos to react vigorously and release elemental phosphorus from the ferrophos.

In the case of the nontransferred-arc being used as the heating vehicle for the plasma furnace, the plasma tail flame that impinges on the surface of the melt will also heat the melt but will not be as concentrated as the anode spot which is obtained when using the transferred-arc system. However, even when using the nontransferred-arc heating means, the surface of the melt will be hotter then the body of the melt since heat is being transferred into the body through the surface of the melt.

While it is not certain what caused the attack of the walls of the carbon crucible, the following explanation is compatible with the observed crucible attack and the observed prevention of the attack by the addition of carbon as set forth above.

It is significant that the crucible attack is not a general attack on all the interior surfaces of the crucible, but rather is concentrated at and immediately below the melt surface contacting the side wall of the carbon crucible. This would indicate that melt circulation has some impact on the location of the crucible attack, although the circulation is not vigorous enough to cause an erosion or wearing away of the crucible at the surface of the melt. Apparently, the heat input from the plasma arc causes the melt to circulate from the anode spot (or other hot heating zone at the surface of the melt) to the crucible walls, down the walls, back to the center of the crucible bottom and finally upward to the anode spot again. Since the hottest melt site is where the arc touches the surface of the melt, this is also the site of highest temperature and of highest phosphorus evolution. Therefore, the arc spot is the most carbon-unsaturated location both because of increased temperature and because of phosphorus depletion. The melt circulation in turn delivers this carbon-unsaturated portion of the melt to the crucible wall where the melt dissolves carbon from the wall and causes the ring attack at that point. The determination by applicants that the carbon concentration of the ferrophos, at furnace temperatures, increases by a factor of 2.6 times is consistent with this hypothesis.

The addition of carbon to the melt allows the added carbon to be dissolved into the melt where the melt is at its highest unsaturated state with respect to the carbon, namely, the surface of the melt. The added carbon preferentially dissolves in the melt permitting the carbon of the crucible to remain essentially free of attack. The reason for desiring to have particles of carbon floating on the melt in the vicinity of the crucible walls is to assure that excess carbon, that is undissolved carbon, is available to dissolve into the melt at its surface where carbon unsaturation is at its greatest. The presence of granules of carbon on the surface of the melt assures that excess carbon is available and that the melt has been saturated with respect to its carbon solubility at whatever temperature the melt surface has reached.

Determination of carbon solubilities in the melt at various temperatures has not been found easy to achieve due to certain factors which can give erroneous results. Chief among these is the erroneous values obtained when the sample cools if the melt is held at a lower temperatures before freezing. Since carbon solubility decreases with temperature, the dissolved carbon in the sample tends to precipitate from the melt, and since it has less density than the other ingredients, it rises to the top and mixes with the scum and impurities that rise to the surface. Since this portion is not included in the sample, the melt shows lower carbon values than were actually present. We have found the best sampling technique is to quench the sample rapidly after removal from the furnace to trap the actual dissolved carbon.

Another problem is the inclusion of carbon in the sample due to carbon contamination because of minute particles of carbon from the furnace, or added carbon, adhering to the surface of the metal. This requires diligence to see that the surfaces of the sample do not include such adhered carbon.

The following examples are given to illustrate the invention, without intending to be limiting thereof.

EXAMPLE I—CRUCIBLE ATTACK

A transferred plasma arc was maintained from a water-cooled cathode to the surface of a ferrophos melt contained in a 12-inch diameter by 10-inch high graphite crucible. The plasma gas employed was argon. 2.8 kilograms of ferrophos previously heated to 2100° C. was heated further at 2370° C. for 101 minutes. After removal of phosphorus vapors overhead and recovery of the residual metal concentrate from the crucible, the graphite crucible inner wall was found to be undercut with a ring-like groove at and just below the level of the melt surface. The groove measured ¾ of an inch in width and varied from ⅛ to 3/16 inch in depth.

EXAMPLE II—CRUCIBLE ATTACK

In another test carried out as set forth in Example I, 4.4 kilograms of ferrophos previously heated to 2200° C. was heated for 216 minutes at a temperature of 2460° C. After removal of $P_4$ vapors and the residual metal concentrate, a similar ring-like groove was formed in the inner wall of the graphite crucible, one inch wide and which varied from 1/8 to ¼ inch deep.

EXAMPLE III—CARBON SOLUBILITY

Another test was carried out as in Example I with 10 kilograms of similar ferrophos that was heated in the transferred-arc furnace for a total of 148 minutes at temperatures up to 2300° C. Initial and final analysis of iron, carbon and phosphorus in the melt phase are given below. The samples of melt that were taken were quenched rapidly to trap all dissolved carbon in the melt at the melt temperature.

| Mineral | Initial (wt/%) | Final (wt/%) |
|---|---|---|
| Fe | 60.2 | 68.0 |
| P | 21.8 | 2.1 |
| C | 2.5 | 6.5 |

These results show that the solubility of carbon increased from 2.5% in the original ferrophos to 6.5%, an increase of 2.6 times the original carbon content.

EXAMPLE IV—PROCESS OF THE INVENTION

Another test was run as in Example I except that 1 kilogram of ground anthracite coal was mixed with 10 kilograms of ferrophos and simultaneously fed to the same furnace operating at a melt temperature of 2150° C. over a period of 81 minutes. The temperature of the furnace was increased and held at 2200° C. to 2350° C. for 75 minutes until the $P_4$ values of the ferrophos were reduced from an initial 21.8% to 1.4%. Carbon particles were observed floating on the surface of the melt. No groove at or below the level of the melt, or elsewhere, was observed in the inner walls of the carbon crucible. The original machining marks on the inside of the crucible from cutting the crucible cavity were still clearly observable.

We claim:

1. A process for reducing cavity formation in carbon crucibles used to contain iron-based compositions containing valuable metals in essentially a nonoxidized form that are heated in a plasma furnace to a temperature of from about 2000° C. to about 2700° C. to form a melt, comprising adding carbon particles to the crucible in amounts of at least about 6 weight percent of the melt but always in amounts at least equal to the solubility of carbon in the melt.

2. Process of claim 1 wherein the carbon particles are added in amounts exceeding the solubility of carbon in the melt at the melt temperature.

3. Process of claim 1 wherein the carbon particles are added in amounts of from about 6% to about 10 weight percent of the melt.

4. Process of claim 1 wherein the plasma furnace is of the transferred-arc type.

5. Process of claim 1 wherein the plasma furnace is of the nontransferred-arc type.

6. Process of claim 1 wherein the iron-based composition is ferrophos.

7. Process of claim 2 wherein the carbon particles are added in amounts sufficient to float on the surface of the melt.

8. A process for reducing the attack and cavity formation in carbon crucibles used to contain ferrophos that is heated in a plasma furnace to a temperature of about 2000° C. to about 2700° C. to form a melt lower in phosphorus content and higher in vanadium and chromium comprising adding carbon particles to the crucible in amounts of at least about 6 weight percent of the melt.

9. Process of claim 8 wherein the carbon particles are added in amounts exceeding the solubility of carbon in the melt at the melt temperature.

10. Process of claim 8 wherein the carbon particles are added in amounts of about 6% to about 10 weight percent of the melt.

11. Process of claim 8 wherein the carbon particles are added in amount sufficient to float on the surface of the melt.

* * * * *